United States Patent [19]

Gerwin

[11] 4,126,410

[45] Nov. 21, 1978

[54] FUEL BURNER

[75] Inventor: Reinhard Gerwin, Stuttgart-Ost, Germany

[73] Assignee: J. Eberspächer, Esslingen am Neckar, Germany

[21] Appl. No.: 775,885

[22] Filed: Mar. 9, 1977

[30] Foreign Application Priority Data

Mar. 10, 1976 [DE] Fed. Rep. of Germany ..... 2609987

[51] Int. Cl.[2] ..... F23Q 3/00

[52] U.S. Cl. ..... 431/265; 239/424

[58] Field of Search ..... 431/265, 168; 239/405, 239/406, 424

[56] References Cited

U.S. PATENT DOCUMENTS

| | | | |
|---|---|---|---|
| 1,855,339 | 4/1932 | Cornelius | 431/265 |
| 2,200,826 | 5/1940 | Johnson | 431/168 |
| 2,236,181 | 3/1941 | Kucher | 431/265 |
| 2,292,664 | 8/1942 | Schwartz | 431/265 |
| 3,211,207 | 10/1965 | Luft | 239/406 |
| 3,694,135 | 9/1972 | Dancy et al. | 431/265 |

*Primary Examiner*—Carroll B. Dority, Jr.

*Attorney, Agent, or Firm*—Toren, McGeady and Stanger

[57] ABSTRACT

A fluent fuel burner capable of efficiently overcoming high system resistances to combustion gas flow by providing a construction which includes a housing that contains at least one combustion air fan whose rotor is straddled by airflow channels extending along its radial sides and discharging through the fan outlet into a by-pass which communicates with a collecting chamber located within range of the burner discharge nozzle and the diffuser. The collecting chamber includes a guide element which cooperates with the by-pass to virtually provide an axial approach to the diffuser thereby resulting in a compact construction with very low airflow pressure losses.

15 Claims, 4 Drawing Figures

FUEL BURNER

BACKGROUND OF THE INVENTION

The invention relates to liquid and gaseous fuel burners and more particularly to a compact arrangement of burner components including at least one combustion airflow fan and related conduits capable of efficiently overcoming the high system resistances to combustion gas flow experienced with small boilers, and with long and narrow stacks or exhaust pipes.

Many of the liquid and gaseous fuel burners of the prior art employ radial flow fans which are incapable of overcoming high system resistances to combustion gas flow due to a limitation imposed by the frequency of the alternating current of a stationary power source. A higher fan speed can be achieved through the use of a direct current source as disclosed in German Pat. No. 2,101,462, however, lack of space imposes a limitation on rotor size and even a multi-stage fan cannot overcome system resistances greater than 500 N/qm. Accordingly, these prior art burners are not suitable for use with small boilers having high system resistances, and with long and narrow stacks or exhaust pipes.

German Pat. No. 1,579,792 discloses a vehicle liquid fuel heater equipped with a side channel combustion airflow fan that is capable of trouble-free operation at high system resistances. However, this prior art arrangement requires fan operation at peak level with concomitant high electric power consumption, and is therefore at a disadvantage when applied to a vehicle whose power supply consists of a starter battery allowing for only relatively low electric power consumption. Furthermore excessively high blade speeds are required when operating the side channel fan at peak level, and consequently the burner requires either an auxiliary motor or an elaborate reduction gear for driving low speed accessory apparatus such an an oil pump or a gas compressor.

German Pat. No. 2135093 discloses a multiflow gated side channel airflow fan for use with fuel burner heaters for motor vehicles, wherein the burner output increases with the number of flows while maintaining a sufficiently steep head characteristic to insure pulsation-free burner operation even at relatively low fan speeds. This prior art arrangement is of compact dimension and provides delivery against high system resistance at low electric power consumption, however, it still requires speeds which are too high to allow operation of accessory apparatus without resorting to additional equipment in the form of an auxiliary drive motor or an elaborate reduction gear drive.

SUMMARY OF THE INVENTION

The present invention comprises a fluent fuel burner which has low electric power consumption and operates at such low speed as to enable accessory apparatus like an oil pump or a gas compressor to be driven directly by the combustion airflow fan motor. The fan is of compact construction and has a sufficiently steep head characteristic to insure pulsation-free operation with boilers having high system resistances, and with long and narrow stacks or exhaust pipes. The burner of the present invention can be employed with both stationary and vehicle heaters without requiring adaptation to the boiler in use, and is of such small dimensions as to permit the utilization of inexpensive and highly efficient space-saving boilers.

Accordingly, there is provided a fluent fuel burner having a motor fitted with a drive shaft which extends into a housing and is connected to a combustion air fan disposed therein. Pursuant to the invention, the fan comprises a rotor having a plurality of circularly spaced blades mounted on the drive shaft. The blades are of rectangular configuration and lie along planes parallel to the longitudinal axis of the shaft. The rotor is straddled by airflow channels which extend along its radial sides and are arranged for joint discharge through the fan outlet. A by-pass communicates with the outlet to convey the combustion air to the outside of the housing. A diffuser for promoting the mixing of fuel and air is disposed outside of the housing in spaced relation to the forward end thereof. A fuel discharge nozzle is interposed between the diffuser and the housing, and is positioned in substantially coaxial relation to the diffuser. An ignition device is used to light the fuel-air mixture.

The arrangement of the present invention, wherein the rotor is straddled by airflow channels extending along its radial sides, achieves a much greater delivery capacity, even for a simple flow design, than is possible with fans which have airflow channels extending along only one of the radial sides of the rotor.

The present invention permits fan operation at a surprisingly low speed so that accessory equipment such as a fuel delivery device can be operated from the fan motor with concomitant savings in power consumption. The invention also provides for pulsation-free operation on boilers having high system resistances, and long and narrow stacks or exhaust pipes, thereby eliminating the need for adapting the burner to a particular boiler, and making the burner suitable for use with inexpensive and highly efficient space saving boilers.

The burner of the present invention retains surprisingly small dimensions notwithstanding the added axial clearance required to accommodate the rotor side airflow channels. This compact burner construction is achieved by positioning the diffuser and discharge nozzle in close proximity to the housing.

Electric power consumption with the present invention is kept to a minimum by providing a low resistance flow path through the use of a by-pass which is disposed within the housing and communicates with the joint discharge of the rotor side channels to convey the combustion air to a collecting chamber situated outside of the housing.

Another feature of the invention is to position the fan inlet channel within the housing and adjacent to the by-pass, and to construct the housing with a protruding wall portion to accommodate the by-pass as it is formed around a baffle disposed within the housing thereby defining an advantageously short path for the flow of combustion air while also enabling the side channels to extend over virtually the entire circumference of the rotor.

A further feature of the invention is to have at least one guide element disposed within the collecting chamber, with a portion of the element preferably extending into the by-pass. This arrangement provides low pressure loss airflow guidance in an extremely space-saving manner while also insuring a nearly axial approach to the diffuser.

In a preferred embodiment of the invention, the motor is fitted into a recess formed on a cover on the fan housing and situated adjacent to the rotor. The motor has one end of its drive shaft connected to the fan and the other end to a fuel delivery device. This arrangement provides a compact and extremely space-saving construction and results in a further reduction in electric power consumption, since the driven accessory apparatus requires less power at low speed. Moreover, low speed operation increases the service life and decreases the noise emission level of the accessory apparatus.

According to another feature of the invention, the cover on the fan housing includes a flange which supports accessories normally associated with burners such as an ignition transformer, a controller and a cable sleeve. The accessories are disposed in surrounding relation to the motor and, if included, the fuel delivery device. Moreover, the flange is preferably arranged to receive, along its outer peripheral edge, a hood that covers the burner accessories and cooperates with a sound absorber to attenuate the noises emanating from the fan suction and the fuel delivery device.

According to still another feature of the invention, the fan housing includes a flange which carries the diffuser, while also serving as an expedient for securing the entire burner to the boiler by being formed with support brackets which provide a compact and space-saving means for fastening the burner to the boiler.

DETAILED DESCRIPTION OF THE PREFERRED EMBODIMENT

Figure 1:
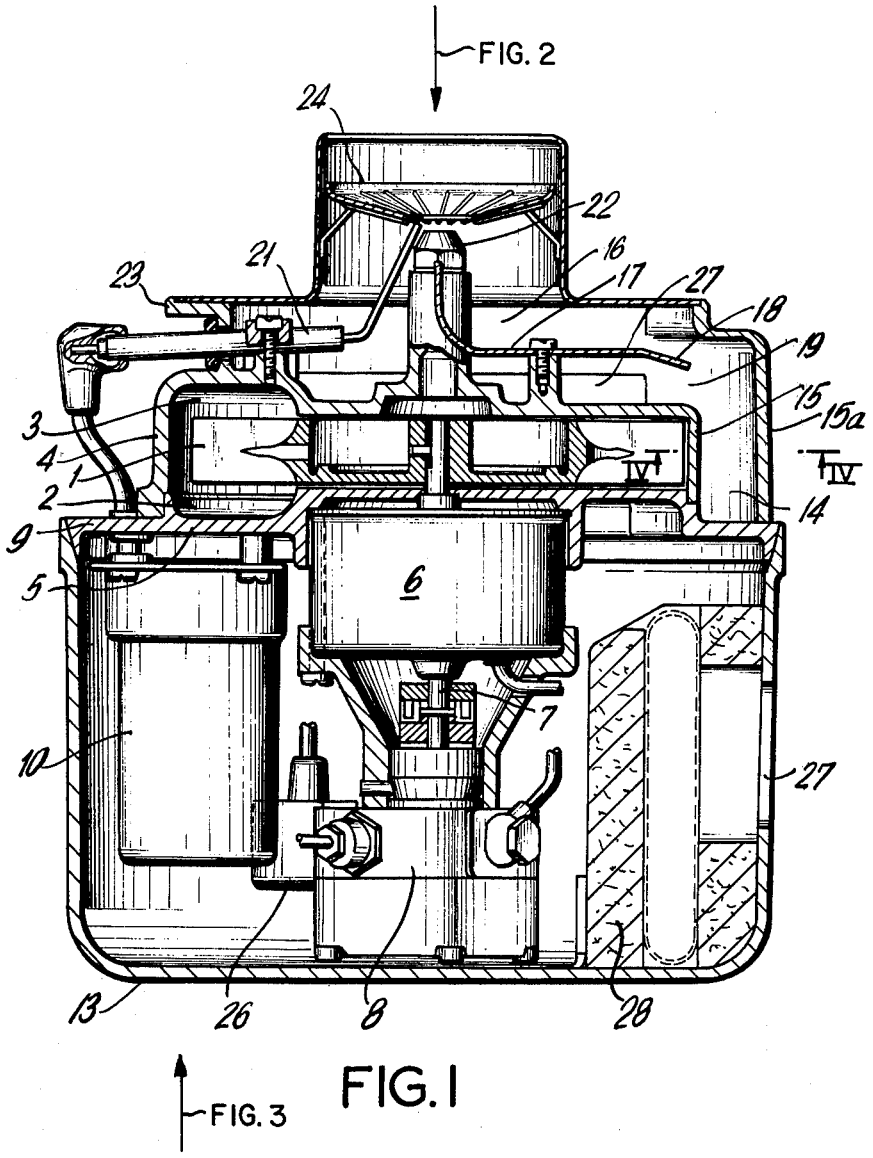
FIG. 1 is an axial cross section of a burner embodying the invention.

Referring to FIG. 1, there is shown a combustion air fan having a rotor 1 and a pair of airflow channels 2 and 3 extending along the radial sides of the rotor 1. The rotor has a plurality of circularly or angularly spaced rectangularly shaped blades disposed in planes parallel to the axis of the rotor. The channel 3 is formed between a fan housing 4 and the rotor 1, and the channel 2 is between a fan housing cover 5 and the rotor 1. A recess is formed in the cover 5 and extends into the airflow channel 2 to accommodate the positioning of a motor 6 having a drive shaft whose one end is connected to the rotor 1. The cover 5 includes a flange 9 which provides a space-saving support arrangement for accessories, normally associated with burners, such as an ignition transformer 10, a controller 11 and a cable sleeve 12. The outer peripheral edge of flange 9 receives a hood 13 that covers the burner accessories and includes a combustion air inlet port 27 around which there is arranged a sound absorbing device 28. If a fuel delivery device 8 is required for the operation of the burner, the device 8 is arranged to be driven by the motor 6 by being coupled to the other end 7 of the motor drive shaft.

Figure 3:
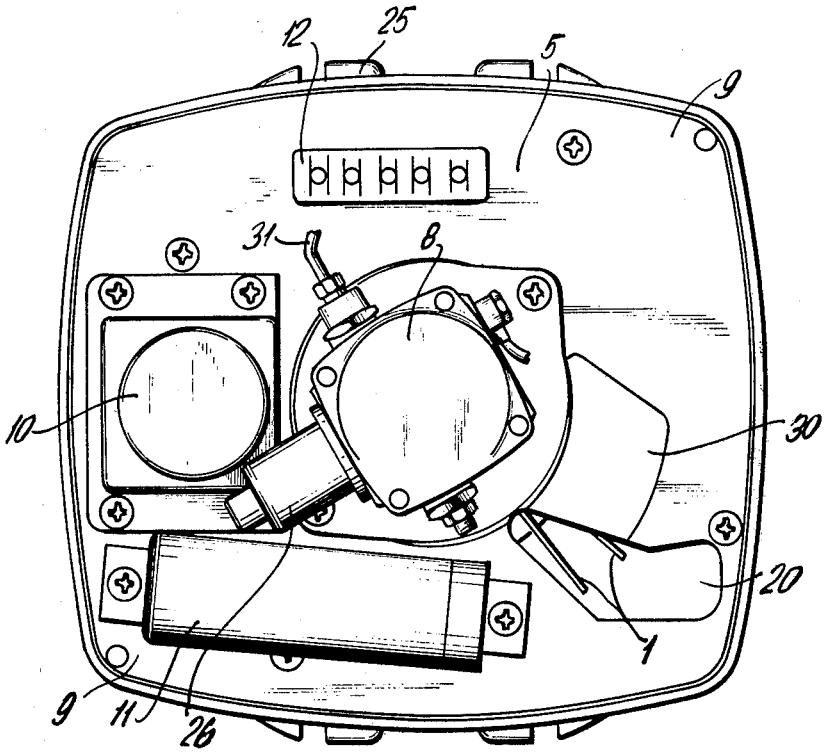
FIG. 3 is an end view of the burner as seen in the direction of the fuel-air mixture flow, and with the hood removed.

During operation of the burner, the combustion air enters the hood 13 at the inlet 27 and passes through the sound absorbing device 28 and into the fan inlet channel 20, shown at FIG. 3. The fan conveys the combustion air, in a known manner, by directing it along substantially helical paths between the rotor blades and through the rotor side channels 2 and 3. The air leaving the side channels 2 and 3 is conveyed through the fan outlet 29, shown in FIG. 4, into a by-pass 14 which extends over a baffle 15. The combustion air is conveyed through the by-pass outlet opening 19 to a collecting chamber 16 and therefrom directly to the fuel discharge nozzle 22 and the diffuser 24 which prepare the fuel-air mixture and are situated outside of the fan housing 4. An airflow guide element 17 is disposed within the collecting chamber 16. The guide element 17 is comprised of a plate shaped substantially as shown at FIG. 1, and includes a portion which extends into the opening 19 of by-pass 14. The arrangement of by-pass 14 and guide element 17 is such as to virtually provide an axial approach to the diffuser 24 thereby resulting in an extremely space saving construction with very low airflow pressure losses.

The arrangement of the fuel discharge nozzle 22 shown in FIG. 1 may comprise, depending on the fuel used, either an oil atomizer or a gas mixing nozzle. The electrode holders 21 and either of the two types of fuel discharge nozzle 22 are received by means formed on the fan housing 4 within the range of the collecting chamber 16. The fan housing 4 includes a flange 23 which supports the diffuser 24 while also serving to fasten the burner to the boiler in a space-saving manner.

Figure 2:
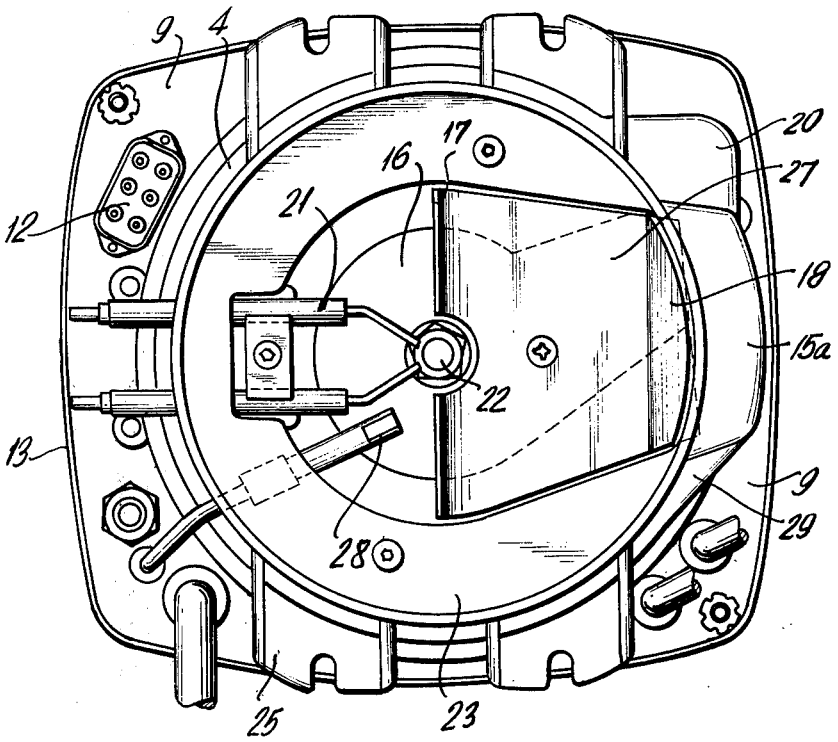
FIG. 2 is an end view of the burner as seen from a direction opposite to that of the fuel-air mixture flow, and with the diffuser removed.

FIGS. 1 and 2 show the by-pass 14 as a protruding wall portion 15*a* of the fan housing 4. During operation of the burner, the aspirated combustion air enters the fan through the inlet channel 20 situated adjacent to the by-pass 14, and leaves the fan through outlet 29 and by-pass 14 from whence it flows into the collecting chamber 16, with one portion of the air passing over the guide element 17 and the other portion below the guide element 17 through a recess 27 shown in dotted lines at FIG. 2.

FIG. 2 also shows the arrangement of the ignition electrode holders 21, the flange brackets 25, a photoelectric element 28 serving to monitor the burner flame, and the flange 9 which forms a tight seal with the hood 13.

FIG. 3 shows the cover 5 formed with the opening to the inlet channel 20. The combustion air enters the fan through the opening of inlet channel 20 and a recess 30 formed on the cover 5 adjacent to this opening. The cover 5 includes the flange 9 which supports the ignition transformer 10, the controller 11 and the cable sleeve 12. The fuel delivery device 8 is equipped with a magnetic valve 26 which controls the flow of fuel to the discharge nozzle 22.

Figure 4:
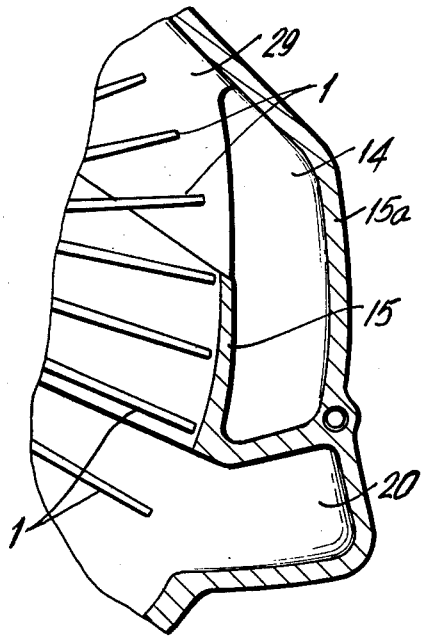
FIG. 4 is a partial radial cross section of FIG. 1 taken along line IV—IV.

FIG. 4 shows the inlet channel 20 arranged next to the by-pass 14, with the latter extending beyond the baffle 15.

The present invention has the advantage of providing pulsation-free burner operation for boilers having high system resistance to combustion gas flow and in connection with long and narrow stacks or exhaust pipes, while also eliminating the need for adapting the burner to the particular boiler in use.

Accordingly, the invention provides a universal burner for use with either stationary or vehicle heating systems and which has low electric power consumption and requires only one motor to drive the combustion air fan and such accessory apparatus as a fuel delivery device. The burner of the present invention is applicable to extremely space-saving and cheap boilers with high efficiency and low emission of pollutants. Moreover, the burner itself is constructed in a space-saving and compact manner and insures a trouble-free operation which has a low emission of pollutants.

While in accordance with provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. A fluent fuel burner including a housing, a motor having a drive shaft extending axially of the housing, said drive shaft having an axis, means for supplying combustion air to the burner including at least one fan disposed within the housing and having an outlet formed therein, the fan having a rotor comprised of a plurality of circularly spaced blades mounted on one end of the shaft, means for supplying fuel to the burner including a discharge nozzle, a diffuser for mixing the fuel and air, and ignition means for lighting the fuel-air mixture, wherein the improvement comprises that said housing has a first housing compartment containing said motor and a second housing compartment containing said fan with said drive shaft extending from said first housing compartment into said second housing compartment, said second housing compartment comprising a fan housing cover extending transversely of said drive shaft and located between said fan and said motor and another cover extending transversely of said drive shaft and located on the opposite side of said fan from said fan housing cover, said rotor blades extending radially outwardly of said drive shaft between said fan housing cover and said another cover with said blades being of rectangular shape and disposed in planes parallel to the axis of said drive shaft, said rotor having a first side adjacent and spaced in the axial direction of said shaft from said fan housing cover and a second side adjacent and spaced in the axial direction of said shaft from said another cover, said first side of said rotor and said fan housing cover and said second side of said rotor and said another cover each forming an airflow channel extending along the radial sides of said rotor blades and arranged for joint discharge through the fan outlet, said another cover including a by-pass communicating with the outlet, and means to convey combustion air from said by-pass to said diffuser, the diffuser being disposed outside of said housing on the opposite side of said second housing compartment from said first housing compartment and in spaced relation from said another cover, the fuel discharge nozzle being interposed between the diffuser and said another cover, and said diffuser and nozzle being positioned in substantially coaxial relation to one another.

2. A fluent burner according to claim 1 including the by-pass formed by a protruding wall portion of said second housing compartment.

3. A fluent fuel burner according to claim 1 including a baffle disposed within said second housing compartment, and having the by-pass extending over said baffle.

4. A fluent fuel burner according to claim 1 including a fan inlet channel formed within said housing in said first housing compartment, said inlet channel being disposed adjacent to said by-pass.

5. A fluent fuel burner according to claim 1 including means in combination with said another cover forming a collecting chamber located on the outside of said housing, and having the by-pass communicating with said chamber.

6. A fluent fuel burner according to claim 1 including at least one airflow guide element disposed in said collecting chamber for directing air from said by-pass to said diffuser.

7. A fluent fuel burner according to claim 6 wherein the guide element has a portion thereof extending transversely of the axis of said drive shaft and into said by-pass.

8. A fluent fuel burner according to claim 1 wherein said motor is fitted to said fan housing cover.

9. A fluent fuel burner according to claim 8 including said fan housing cover being formed with a flange, and said ignition means supported from said flange.

10. A fluent fuel burner according to claim 9 wherein said ignition means includes a transformer, and a controller for actuating said transformer.

11. A fluent fuel burner according to claim 1 including a fuel delivery device, said shaft having another end extending from the opposite side of said motor from said one end of said shaft and said fuel delivery device mounted on the another end of said shaft.

12. A fluent fuel burner according to claim 1 wherein the ignition means includes a pair of electrode holders.

13. A fluent fuel burner according to claim 12 wherein said housing includes a collecting chamber and means for receiving the electrode holders and fuel discharge nozzle within range of said collecting chamber.

14. A fluent fuel burner according to claim 1 including the housing being formed with a flange, and having the diffuser secured to said flange.

15. A fluent fuel burner according to claim 1 including said first housing compartment being formed with a flange providing a support arrangement for burner accessories.

* * * * *